US006360923B1

(12) United States Patent
Vlooswijk

(10) Patent No.: US 6,360,923 B1
(45) Date of Patent: Mar. 26, 2002

(54) DEVICE FOR DISPENSING A LIQUID UNDER PRESSURE

(75) Inventor: Johannes Jacobus Thomas Vlooswijk, Linschoten (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/623,732

(22) PCT Filed: Mar. 16, 1999

(86) PCT No.: PCT/NL99/00144

§ 371 Date: Nov. 14, 2000

§ 102(e) Date: Nov. 14, 2000

(87) PCT Pub. No.: WO99/47451

PCT Pub. Date: Sep. 23, 1999

(30) Foreign Application Priority Data

Mar. 16, 1998 (NL) ..... 1008601

(51) Int. Cl.[7] ..... B65D 83/00
(52) U.S. Cl. ..... 222/399; 222/183
(58) Field of Search ..... 222/95, 399, 183

(56) References Cited

U.S. PATENT DOCUMENTS 4,049,158 A * 9/1977 Lo et al. ..... 222/399
5,234,140 A * 8/1993 Demarest et al. ..... 222/399

FOREIGN PATENT DOCUMENTS

| | | |
|---|---|---|
| EP | 0 195 692 A | 9/1986 |
| EP | 0 312 078 A | 4/1989 |
| FR | 2 331 485 A | 6/1977 |
| FR | 2 690 142 A | 10/1993 |
| WO | 95 17340 A | 6/1995 |

* cited by examiner

*Primary Examiner*—Philippe Derakshani
*Assistant Examiner*—Thach H Bui
(74) *Attorney, Agent, or Firm*—Pearne & Gordon LLP

(57) ABSTRACT

A device for storing and dispensing carbonated beverages such as beer is provided. The device has a fluid compartment and a propellant compartment which are connected through a pressure control means. The pressure control means delivers propellant from the propellant compartment to the fluid compartment as the beverage is withdrawn therefrom to maintain a desired excess equilibrium pressure of the propellant in the headspace of the fluid compartment. For carbonated beverages, the propellant is preferably relatively pure $CO_2$, and also ensures proper carbonation to the beverage. A method of dispensing a carbonated beverage is also provided.

26 Claims, 4 Drawing Sheets

DEVICE FOR DISPENSING A LIQUID UNDER PRESSURE

The invention relates to a device for dispensing a fluid according to the preamble of claim 1. Such device is known from FR-A-2 331 485.

U.S. Pat. No. 5,368,207 discloses a device comprising a pressure container in which a fluid to be dispensed can be stored in a first chamber, while a second chamber is included for storing and dispensing a propellant. Via pressure control means, the second chamber is in fluid communication with the first chamber. The pressure control means are arranged for passing the propellant from the second chamber into the first chamber at a specific, preset pressure. In such device, during use, the fluid is pressurized in the first chamber by means of the propellant and when suitable dispensing means are opened, the fluid is thus driven from the first chamber.

This known device has as a drawback that the ratio between the volume of the first chamber and the volume of the second chamber is unfavorable. To enable storing sufficient propellant in the second chamber for dispensing the complete contents of the first chamber at a suitable pressure, the second chamber must be relatively large in relation to the first chamber. As a consequence, the device as a whole has an unfavorable ration between outside dimensions and effective content of the first chamber.

It has already been proposed to increase the pressure in the second chamber such that at a smaller volume, the same amount of propellant can be included therein. However, this has the drawback that the pressure control means and the walls of at least the second chamber should be accommodated to such increased pressures, which is technically complicated and costly. Moreover, such increased pressures are usually unacceptable without extreme safety measures, on account of conditions with respect to production and usage.

Further, such device has the drawback that relatively much material is used and that such device is relatively heavy.

FR-A-2 331 485 discloses a device for dispensing a fluid, comprising a container having a first and second compartment. In the first compartment a fluid to be dispensed can be introduced, in the second compartment the propellant. An opening is provided between the first and second compartment in which pressure control means are arranged for controlling the pressure of propellant flowing from the second into the first compartment. In this device fillers are provided in the second compartment for adsorbing and absorbing part of the propellant, in order to enable storage of a relatively large quantity of propellant under relatively low pressure. This known device is arranged for spraying furniture polish and the like. During use the pressure of the propellant is arbitrarily chosen.

The object of the invention is to provide a device according to the introduction, wherein the drawbacks mentioned are avoided, while the advantages thereof are retained. To that end, a device according to the invention characterized by the features of claim 1.

In a device according to the present invention, a filler is included in the second compartment for associating at least a portion of the propellant, which portion can hence be introduced into the second compartment without the pressure therein being considerably increased. The surprising effect thus achieved is that under equal conditions of use, a considerably larger volume of propellant can at a preselected pressure be introduced into the second compartment filled with propellant, than in a second chamber of the known device, at the same pressure. This means that in a device according to the invention, the second chamber can be relatively small compared with the first chamber, while a large volume of propellant can nevertheless be introduced into the second chamber at a relatively low pressure. This means that no specific measures are necessary for rendering the pressure control means and the walls of the second compartment resistant to extreme pressures.

Surprisingly, it has been found that for dispensing carbonated beverages, in particular beer, already a relatively slight excess pressure in the chamber in which beverage to be dispensed is included, relative to the environment, leads to a particularly favorable dispensing pattern. In particular, a number of glasses of beer having a suitable head of foam and an optimum $CO_2$ content can be drawn therewith in a relatively fast manner.

In a device according to the invention, techniques known form the aerosol industry, such as valve parts and container, can be utilized in an advantageous and surprising manner.

In an advantageous embodiment, a device according to the invention is characterized by the features of claims 4.

The advantage achieved by using relatively pure carbon dioxide as propellant, with the fillers being substantially formed by activated carbon fibers, is that a particularly large volume of propellant can be introduced into a particularly small space at a suitable pressure, due to the large specific internal and external surface area of the activated carbon fibers. In particular when a device according to the invention is used for dispensing carbonated beverages, the advantage achieved by the relatively high purity is that the propellant can be brought directly into or above the beverage to be dispensed, so that the device may be of a simple construction. Moreover, a desired equilibrium situation is thus always maintained in the head space of the first compartment, which has a positive effect on the quality of the beverage to be dispensed and prolongs the shelf life thereof.

For the use of a device according to the present invention for storing and dispensing beer, in particular of the lager type, an excess pressure is preferably maintained in the head space of the storage compartment (first compartment) of between 0.65 bar and 1.0 bar (1.65–2.0 bar absolute) so as to obtain and maintain an equilibrium in the $CO_2$ content of about 4.6 g $CO_2$ per liter beer at a beer temperature of between 5° C. and 10° C. From Table 1, for other carbonated beverages, the desired excess pressures for desired carbon dioxide contents can be read.

For associating $CO_2$, activated carbon is preferably used, such as activated carbon of the type GF40 or R1Extra, both supplied by the firm Norit, Amersfoort, the Netherlands, as will be further indicated in the specification.

Per liter of fluid to be dispensed, in particular carbonated beverage, preferably between 2 and 20 g activated carbon is included in the second compartment. More in particular, between 6 and 18 g activated carbon is included. Thus, at acceptable pressure, a sufficient amount of $CO_2$ or a like propellant can be associated, while practically no excess carbon is present.

Per liter of fluid to be dispensed, in particular carbonated beverage, preferably between 1 and 10 g of $CO_2$ is stored as pressure medium in the second compartment. It has been found that such amounts are sufficient for displacing the beverage at least substantially completely. In, particular an amount of between 2 and 8 g $CO_2$ proves to yield very good results.

Through a suitable dimensioning of the flow-out device, beer can already be drawn in a suitable manner, i.e. at a proper tapping rate and with a right $CO_2$ content and a nice, full head of foam, at the equilibrium excess pressure of carbon dioxide.

Preferably, there are provided excess pressure relief means for the first and/or second compartment for letting off at least a portion of the pressure medium in a controlled manner when unduly high pressures occur. To that end, for instance, a valve may be arranged or local weakenings may be consciously provided, for instance at folded seams, attachments or the like.

Including both the first and the second compartment in the container offers the advantage that a user need not perform any assembling operations before the device can be used. This adds to the ease of use, comfort and safety of the user. Moreover, assembling errors are thereby avoided, so that waste is prevented. By providing means for filling the second compartment with propellant, from the outside of the container, the advantage achieved is that this filling operation can be performed up to any suitable moment, for instance after filling and after treatment of the fluid in the first compartment. This is advantageous in particular when such fluid in the container is to be exposed to substantial changes of temperature, such as, for instance, in a pasteurization pass.

In an alternative embodiment, a device according to the invention is characterized by the features of claim 8.

In such embodiment, prior to use, the second compartment which is accommodated in a preferably cartridge-shaped housing, can be coupled to the container and be brought into fluid communication with the first compartment. It is thus ensured that prior to use, the container is practically pressureless, or at least retains a relatively low pressure. Only after coupling to the second compartment can the desired increase of pressure be effected. Moreover, the first compartment and the second compartment can be treated separately, which is advantageous in terms of production and use. Indeed, the container with the first compartment can, for instance, be exposed to changes of temperature without the propellant in the second compartment being influenced thereby, while, moreover, the different parts can be manufactured, stored, transported, possibly reused or discharged separately. Further, the advantage thus achieved is that, if so desired, several containers can be brought and kept under pressure simultaneously or consecutively with the same second compartment.

In a further, particularly advantageous embodiment, a device according to the invention is further characterized by the features of claim 9.

The use of a dip tube mounted on the first compartment offers the advantage that this assembly can be placed as a unit. This is advantageous in particular when the dispensing means are integrated into this assembly as well. The dip tube provides that the first compartment can be emptied completely, in a suitable manner. Installation of the assembly can preferably take place after the filling of the first compartment. In fact, it is observed that such assembly can also be supplied separately from the first compartment, such that it can be placed by a user directly prior to use. Moreover, such an assembly can be designed for refilling, at least for being used several times.

The invention further relates to a method for keeping under pressure and dispensing a fluid, characterized by the features of claim 11.

With such a method, the advantage achieved is that by means of a relatively simple device, a relatively large amount of fluid can be dispensed without requiring extreme compression of the propellant and without requiring accommodating propellant in a chamber having a relatively large volume compared with the quantity of fluid to be dispensed. Hence, a device to be used with such a method may be of a relatively small, simple and light design, without this having an adverse effect on the ease of use and safety of the user.

The invention further relates to a pressure cartridge for use in a device, assembly or method according to the invention, characterized by the features of claim 12.

Such a pressure cartridge may, for instance, be designed as a relatively small container, suitable for bringing and maintaining a first compartment under pressure, but may also be designed as, for instance, a $CO_2$ cylinder for bringing and maintaining a number of first compartments or a barrel of a relatively large content under pressure. Of course, a pressure cartridge according to the invention may be filled with all types of fillers, depending on the propellant that is to be stored therein, yet as filler, activated carbon fibers are preferred, in combination with $CO_2$, in view of the relatively universal applicability and possibilities of reuse thereof and the purity of the $CO_2$, as a result of which it can be introduced directly into or above the beverage.

In further elaboration, a pressure cartridge according to the invention is characterized by the features of claim 13.

The use of pressure control means for maintaining, during use, a relatively constant excess pressure, offers the advantage that fluid can always be dispensed in a substantially equal manner. In this respect, accommodating the pressure control means in the pressure cartridge offers the advantage that they can be reused and activated in a relatively simple manner, while they can moreover be used as closing means for the pressure cartridge, if so desired.

The invention moreover relates to the use of a pressure cartridge according to the invention for dispensing a carbonated beverage, in particular beer.

Further advantageous embodiments of a device or method according to the invention are given in the subclaims.

To clarify the invention, a number of exemplary embodiments of a device and method according to the invention will hereinafter be described with reference to the accompanying drawings. In these drawings.

Figure 4:
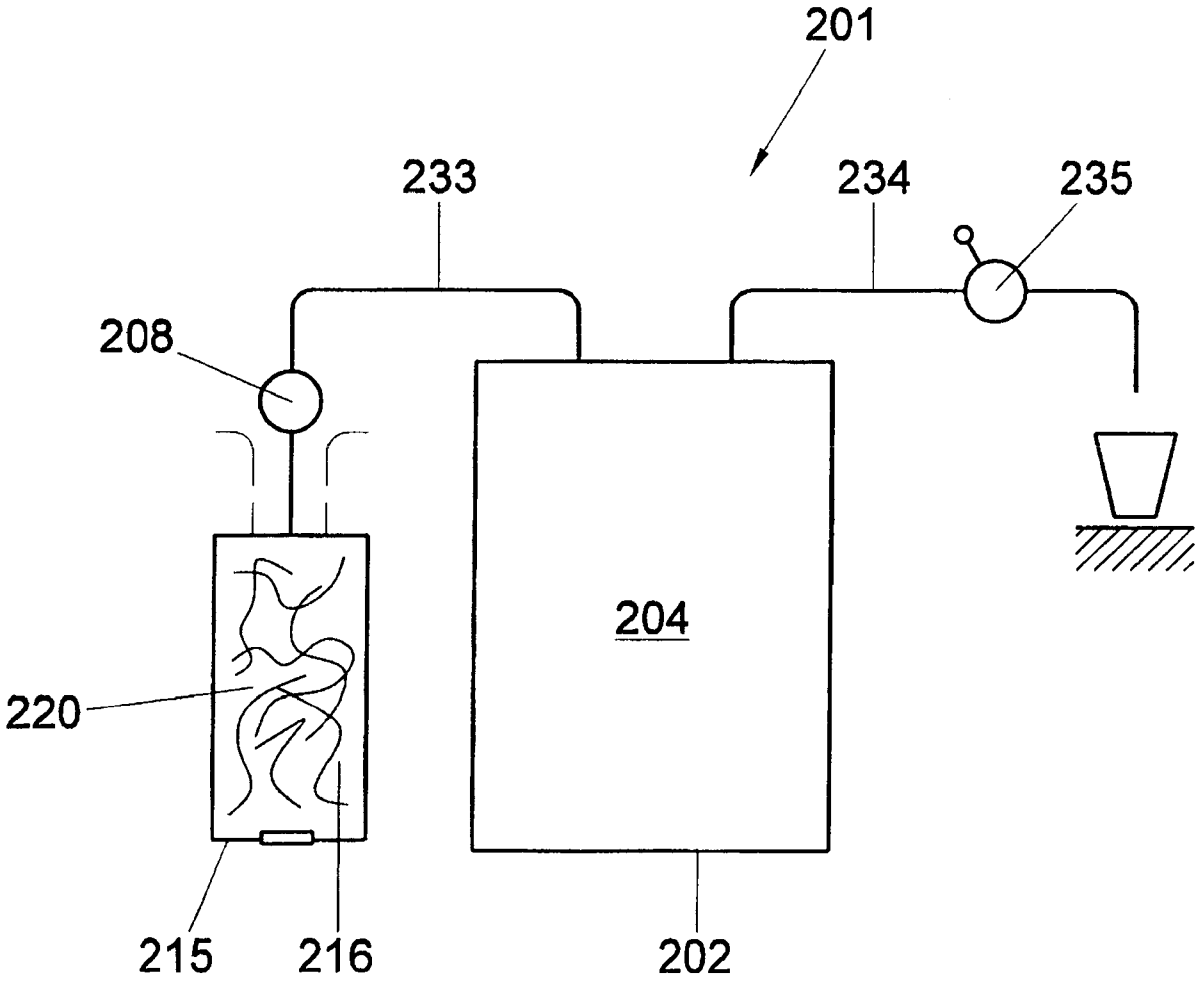
Figure 5:
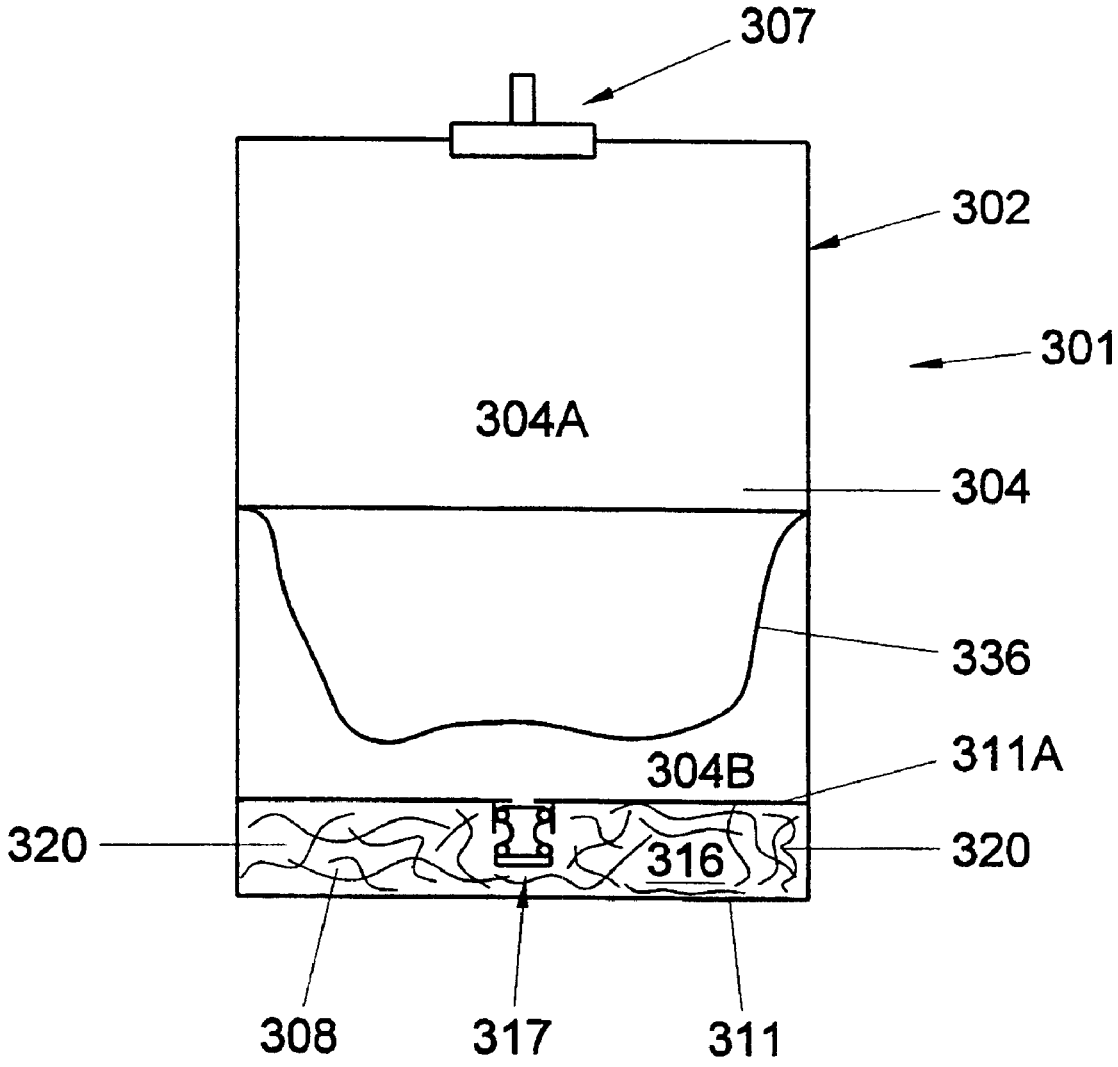

FIG. 4 schematically shows a second alternative embodiment of a device according to the invention; and FIG. 5 schematically shows a third alternative embodiment of a device according to the invention.

In this specification, identical or corresponding parts have corresponding reference numerals. In this specification, the embodiments will be specified with reference to a tapping device for carbonated beverages, in particular beer. However, it will be directly understood that other applications are also possible, for instance the use of such device for dispensing foodstuffs, foamed products, pastas and the like.

Figure 1:
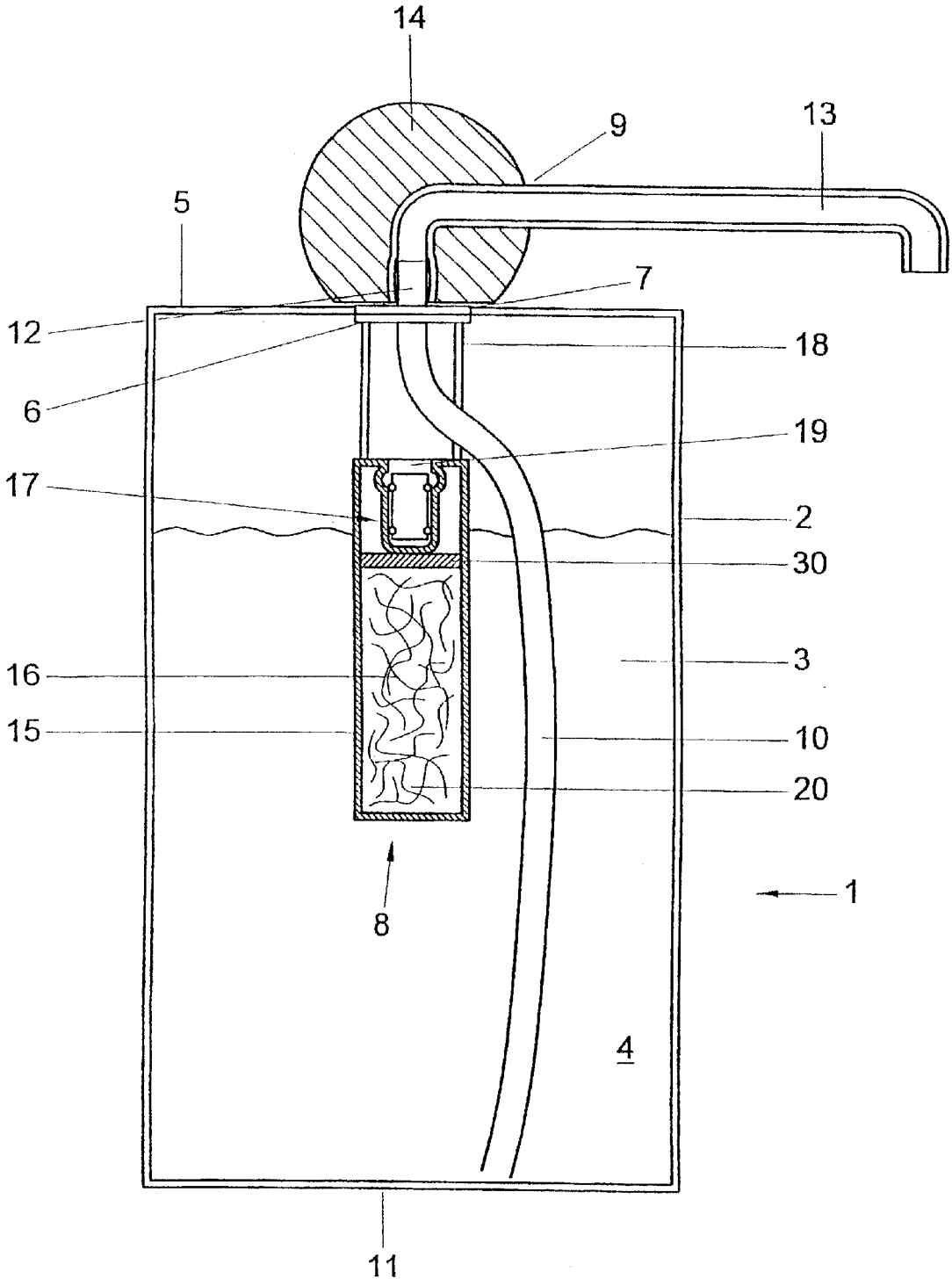
FIG. 1 is a schematic, sectional side elevation of a device according to the invention.

FIG. 1 shows a device 1 according to the invention, comprising a container 2 in which an amount of beer 3 to be dispensed is included in a first compartment 4. In the embodiment shown, the container 2 is a relatively thin-walled can of a relatively large content, for instance 3 or 5 liter. The container 2 is closed all round and has its top face provided with a central opening 6 accommodating dispensing means 7, which will be further described hereinbelow. Extending under the dispensing means 7 is a pressure control device 8, which will also be further described. Connecting to the dispensing means 7 are diverting means 9 for discharging beer 3, via the dispensing means 7, from the container 2 to, for instance, a glass (not shown). To that end, a dip tube 10 extends from the dispensing means 7 to a position adjacent the bottom 11 of the container 2, so that the complete volume of beer 3 can be dispensed via the dispensing means 7 and the diverting means 9.

The dispensing means 7 comprise a passage 12 to which, within the container 2, the dip tube 10 connects and to which, outside the container 2, the diverting means 9 connect. The dispensing means 7 further comprise a shut-off valve (not shown) which can be opened against spring pressure and which in a first position seals the dispensing means 7 and in a second position brings the dip tube 10 into fluid communication with the diverting means 9 or at least a duct 13 extending therein. For operating the dispensing means 7, a knob 14 is provided, which knob, upon a movement in the direction of the top face 5, moves the shut-off means towards the second position, while by said spring pressure, it is moved in the direction of the first position, for shutting off the device when not actuated. Such dispensing means 7 are already known per se and can be adapted or replaced in a known, suitable manner by a skilled person within the framework of the invention.

The pressure control device 8 comprises a housing 15 having a second compartment 16. Provided adjacent the top end of the housing 15 are pressure control means 17 which will be further described hereinbelow. By suspension means 18, the housing 15 is suspended from the top face 5 or the dispensing means 7, such that a passage opening 19 of the pressure means 17 is positioned at some distance below the dispensing means 7, preferably above the liquid level. The pressure control device 8 and the dispensing means 7 are preferably interconnected in such a manner that they can be inserted through the central opening 6 in the top face 5, with the opening 6 being closed by the dispensing means 7 so as to be gastight and liquidtight. Thus, the pressure control device 8 can readily be placed, while it can moreover also be readily removed, at least in a workshop arranged therefor, for reuse or recycling.

Provided in the second compartment 16 is a filler 20, suitable for associating a relatively large amount of propellant. In the embodiment shown, the filler 20 is designed as an amount of activated carbon fibers having a relatively large internal and external surface area, for adsorbing and/or absorbing therein and thereon a relatively large amount of $CO_2$ at an acceptable gas pressure within the second compartment 16.

In an advantageous embodiment, activated carbon, in particular activated carbon fibers having a large specific surface area, preferably between 600 and 1400 $m^2/g$ and a high internal porosity, in particular more than 55% and preferably between 55 and 80%, is used as filler. Moreover, the fibers preferably have a relatively large external specific surface area, for instance more than 2 $dm^3$, more in particular more than 25 $dm^3$. Such activated carbon fibers are commercially available. The use of such filler offers the advantage that the second compartment may be of relatively small design, while sufficient $CO_2$ can yet be associated. By way of illustration, for the complete emptying of a container having a content of 5 l beer, at 7° C. and a desired internal pressure of 1.7 bar, a second compartment having a content of about 40 ml may suffice, at a gas pressure in the second compartment of about 10 bar. In the embodiment shown, a slightly larger second compartment and the same pressure have been opted for (hence a larger amount of propellant), to obtain a safety margin, so that the container is prevented from not being emptied completely. The ratio between the content of the first compartment and the content of the second compartment can for instance be chosen to be >140:1, for instance 66:1. In view of the desired outside dimensions of the device in relation to the content, it is preferred that this ratio be greater than 5:1, more preferably greater than 15:1 and most preferably greater than 50:1. Accordingly, for the complete emptying of an above-described container having a content of about 5 l, approximately 18 l $CO_2$ gas is available, measured at a pressure of 1 bar. It will be directly understood that for any content of a first compartment and the desired excess pressure to be obtained therein, the desired volumes of $CO_2$ and filler can readily be determined, as well as the desired content of the second compartment, related to pressure and temperature. Further, it will be understood that other fillers can also be used, depending on, inter alia, the application opted for, in particular the propellant to be employed. For instance, acid-treated clay, activated aluminum and bauxite, iron oxide, magnesium oxide, silica gel, and suitable liquids such as acetone and the like can be used. When applied to beverages, in particular carbonated beverages and other products suitable for consumption, the use of $CO_2$ offers the advantage that, in normal use, it does not have any adverse effect upon the user. Moreover, $CO_2$ can be obtained relatively easily, for instance as waste product in industrial processes, which reuse is environmentally advantageous.

By way of illustration, an exemplary embodiment will now be described.

A second container with valve, having a content of about 150 ml, was filled with about 70 g activated carbon fibers of the type R1Extra, supplied by Norit, NL. To this, 0.74 mole $CO_2$ was associated, i.e. 33 g. The formula P.V./R.T. teaches that thus, at a beer temperature of 7° C. in a first compartment of 5 l, about 4.850 l beer can be maintained under a pressure of about 1.65 bar (0.65 bar excess pressure) and be dispensed therefrom with particularly good drawing properties, while a 100% safety margin is used. At least initially, the $CO_2$ gas provides a pressure of about 10 bar in the second container. During the life of the tapping device, an equilibrium of about 4.6 g $CO_2$ per liter beer was maintained (Table 1). For this, a discharge channel having a section of about 8–9 mm was used. More generally, preferably between 2 and 20, more preferably between 6 and 18 g activated carbon, and between 1 and 10, preferably between 2 and 8 g $CO_2$ is added per liter of beverage to be dispensed. In comparison, liquid $CO_2$ would lead to unacceptably high pressures of, for instance, 50–60 bar in the second container, whereas the use of gaseous $CO_2$ without associating means would require a second container having a volume of about 0.77 l, at a starting reduced pressure of 10 bar, without safety margin. At a safety margin of 100%, this would, in a 5 l vessel for beer, leave a rest volume for beer of only about 3.5 l.

Graph—showing the carbon dioxide content

The dark strip represents the carbon dioxide standard

TABLE 1

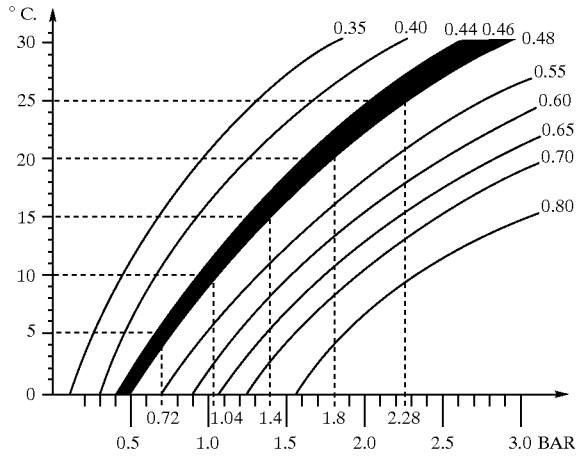

Figure 3:
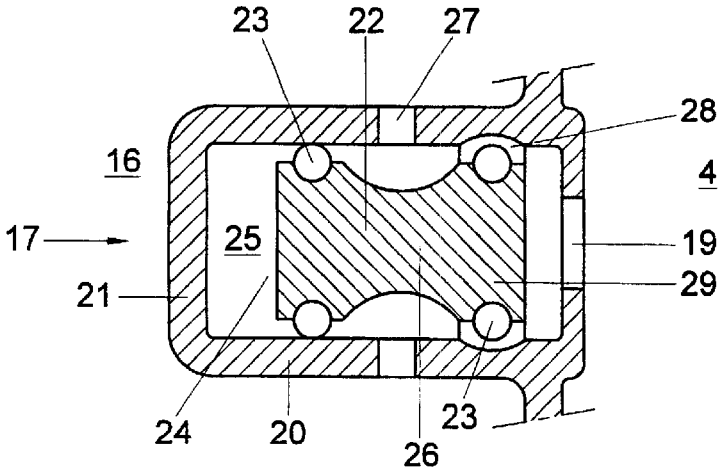
FIG. 3 is a schematic, sectional view of a pressure control means for use in a device according to the invention.

The pressure control device 8 is for instance provided with pressure control means 17, which are shown in more detail in FIG. 3 and are known per se from, inter alia, U.S. Pat. No. 5,368,207, which publication with regard to these pressure control means is considered to be incorporated herein by reference. Such pressure control means, also known by the name of 'pressure generators', are supplied inter alia by the firm Stabilpress, Belgium. The pressure control means 17 comprise a cylindrical casing 20, closed at a first end by a bottom 21 and provided at its other end with a passage opening 19. During use, the passage 19 faces the first compartment 4 and is in open fluid communication therewith. Accommodated in the casing 20 is a slightly hourglass-shaped piston body 22, provided at either end with an O-ring or a like seal 23 abutting against the inside of the casing 20. Between the first end 24 of the piston body 22 and the bottom 21, a first chamber 25 is formed, whose size varies according to the axial displacement of the piston body 22 within the casing 20. At the level of the waist 26 of the piston body 22, a number of openings 27 are provided in the casing 20, which are in fluid communication with the second compartment 16. A circular groove 28 is included between the openings 27 and the passage 19, on the inside of the casing 20, such that when the O-ring fitted adjacent the second end 29 extends at the level of the groove 28, a slightly limited fluid connection is formed between the second compartment 16, via the openings 27, the space between the O-ring 23 and the groove 28 and the passage 19, to the first compartment 4. Gas of a relatively high pressure can then flow from the second compartment 16 and via this fluid connection into the first compartment 4, whereby the pressure in the first compartment 4 increases. In the chamber 25, a reference pressure is provided which approximately corresponds to the desired pressure in the first compartment 4. If necessary, spring means or the like may be accommodated in the first chamber to effect said reference pressure. If the desired pressure in the first compartment has been realized, the piston body 22 is axially displaced in the direction of the bottom 21, such that the reference pressure in the chamber 25 is realized, in which position the O-ring 23 adjacent the second end 29 seals the above-described fluid passage, since the O-ring 23 then abuts against the inside of the casing 20 between the openings 27 and the groove 28. If a portion of the beer 3 will be displaced from the first compartment 4 by the dispensing means 7, the pressure therein will decrease, as a result of which the piston body 22 will, under the influence of the pressure in the chamber 25, be axially displaced in the direction of the passage 19, such that gas can again flow at high pressure from the second compartment 16 along the above-described fluid connection into the first compartment, for restoring the desired pressure therein. When this desired pressure is reached, the piston body 22 is urged into the closing position again. In this manner, a constant, desired pressure will constantly be maintained in the first compartment by the pressure control means. Variations of such pressure control means are described in, inter alia, the above-cited U.S. Pat. No. 5,368,207. It is further observed that other settable or non-settable pressure control means, such as a diaphragm valve, reducing valves and the like, can of course also be used in a device according to the invention. Such embodiments will be directly clear to a skilled person. A pressure control means as shown in FIG. 3 offers the advantage that it can be manufactured in a relatively simple manner and has an accurate action.

Preferably, excess pressure relief means (not shown) are provided in the first and second compartments, for which purpose, for instance, generally known valves or the like can be employed.

As shown in FIG. 1, filtering means 30 are provided in the second compartment 16 for filtering, from the gas flow, particles of the fillers 20, in particular relatively small activated carbon particles, which could have an adverse effect on the quality of the product to be dispensed and, possibly, the health of the user. Moreover, blockages and damages are thus prevented. Such filtering means 30 can be constructed in various manners, for instance gauze-shaped, foam-like, textile, semipermeable polymers and the like. By positioning the filtering means 30 in the second compartment 16, in front of the pressure control means 17 when viewed in the flow direction of the gas, contact between the fluid 3 to be dispensed and the filtering means 30 is prevented. Moreover, particles of the filler 20 are prevented from ending up in the pressure control means 17. In fact, the filtering means 30 may also be provided in the passage openings 27. The filtering means 30 may, for instance, be disposed in the second compartment 16, prior to a closure thereof, for instance with the pressure control means 17.

A device according to FIG. 1 can be employed as follows.

A suitable amount of beer 3 is introduced into the first compartment 4, via the opening 6. Next, the container 1 with the beer can be treated, for instance pasteurized, for which a temporary seal may be inserted into the opening 6, if necessary. Next, the pressure control device 8, together with the dip tube 10 and the dispensing means 7, can be inserted into the container 2 via the opening 6, the dispensing means 7 being secured so as to close off the opening 6, for instance through sealing. During insertion of the pressure control device 8, the piston body 22 can be moved away from a sealing position, in which the second end 29 sealingly abuts against the passage 19, for pressurizing the first compartment 1. Filling is preferably effected at an excess pressure such that the pressure in the first compartment 1 is at least equal to and preferably higher than the desired operating pressure in the head space of said first compartment 1. In a preferred embodiment described earlier, this means, for instance, that filling will take place at a minimum pressure of 1.65 bar, preferably somewhat higher. This ensures that the control device is kept in a closing position during filling, which prevents the premature escape of $CO_2$ from the second compartment. This also enables filling and fitting the second compartment already before the first compartment 1 is filled. Further, the desired pressure will in each case be automatically obtained and maintained. If a consumer wants to remove beer from the first compartment, the diverting means 9 can be placed on the dispensing means 7, whereafter the passage 12 can be released simply by pressing on the knob 14 and the beer 3 is dispensed in a desired amount via the dip tube 10 and the duct 13. Upon release of the knob 14, the passage 12 is closed again as described earlier. When the first compartment 4 has been emptied completely, optionally the pressure control device 8 can be removed again for reuse or separate recycling. Placing the pressure control device can also be done by the user.

In an alternative embodiment, the dispensing means 7 with the diverting means 9, the dip tube 10 and the pressure control device 8 are designed as a unit which can be placed separately. Such a unit can, for instance, be supplied as a loose item and be made of refillable design.

Figure 2:
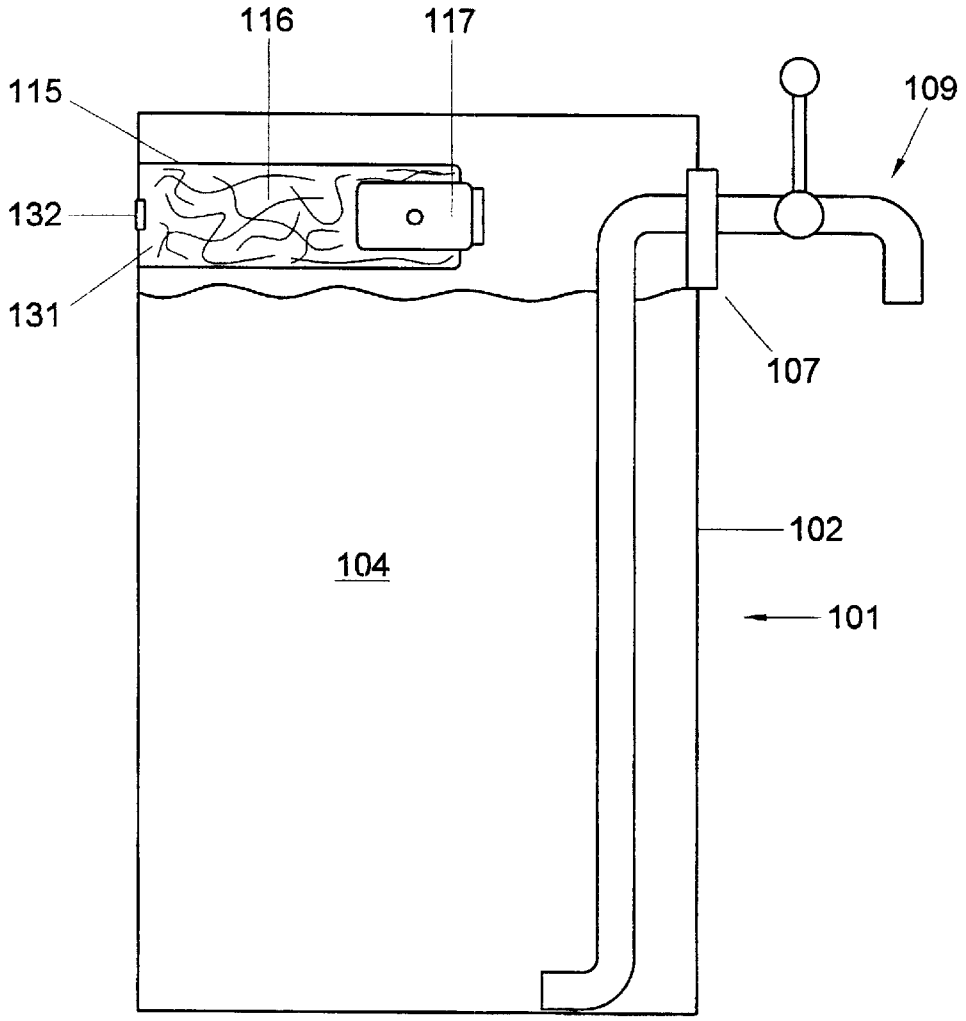
FIG. 2 is a schematic, sectional side elevation of an alternative embodiment of a device according to the invention.

FIG. 2 shows an alternative embodiment of a device 101 according to the invention, in which the dispensing means 107 and the diverting means 109 are fitted in a sidewall of the container 102. Further, the second compartment 116 is fitted in a housing 115, which, at least in normal use, extends entirely above the liquid surface in the first compartment 104. To that end, the housing 115, through its end 131 opposite the pressure control means 117, represented diagrammatically, is likewise secured to the wall of the container 102. In the second compartment 116, again a suitable filler for associating the propellant is provided. In the wall of container 102, in the end 131 of the housing 115, a closable feed opening 132 is provided, via which propellant can be introduced into the second compartment 116. This makes it possible in a particularly simple manner to introduce the propellant into the second compartment 116 after the beer or other fluid has been suitably treated in the first compartment 104, optionally immediately prior to use. It will be clear, for that matter, that the housing 115 can be designed in any desired manner and can also be arranged at other positions. Thus, for instance, the second compartment 116 may be formed in an upper end, designed as a double-walled lid, of the container 2, 102.

FIG. 4 shows an alternative embodiment of a device 201 according to the invention, in which the second compartment 216 is provided in a loose housing 215, which can be connected to the first compartment 204 in a container 202 via a first duct 233. In the first duct 233, a pressure control device 208 is included for controlling a preferably constant pressure in the container 202. The first compartment 204 is connected via a second duct 234 with tapping means 235 with which the passage of the second duct 234, as desired, can be closed or can be released for dispensing beer. As indicated in broken lines in FIG. 4, further first ducts 233 can be connected to the housing 215, so that more containers 202 can be served with gas from the second compartment 216. Also, such a cartridge-like housing can be subsequently connected to a number of containers 204 to empty them. The fillers 220 here provide the advantage that relatively much gas, in particular $CO_2$, can be stored in such a housing, without requiring particularly complex constructional measures and without the safety of the users being thereby affected adversely. In particular in a device 201 according to FIG. 4, containers 202 of a relatively large volume, for instance 10, 30 or 50 liters, can be emptied with a pressure cartridge 215 of a relatively small volume and limited weight. This further provides logistic advantages.

FIG. 5 shows a further alternative embodiment of a device according to the invention, in which the first compartment 304 is divided by a flexible membrane 336, for instance a foil-like bag attached to the wall of the container 302, into a chamber 304A for receiving the fluid to be dispensed and a chamber 304B for receiving a volume of propellant which has flowed from the second compartment 316 via the pressure control means 317 described earlier. The second compartment 316 is positioned between two bottom walls 311, 311A and, again, is filled with a suitable filler 320. Such an embodiment is advantageous in particular when the propellant is to be prevented from coming into direct contact with the fluid to be dispensed in the chamber 304A, since the gas is suitably separated from the fluid by the membrane 336.

The present invention is not in any way limited to the exemplary embodiments shown in the description and the drawings. Many variations thereof are possible within the scope of the invention.

Thus, the dispensing means and/or the diverting means can be differently designed, for instance as in known aerosols for obtaining foam. They may also be designed for single-time operation, whereby the entire first compartment is emptied at one time. The container 2 can be manufactured in a variety of ways and from different materials, for instance steel, aluminum or plastic. In the exemplary embodiments shown, the containers are of relatively high design, but it will be clear that a variety of dimensions can be utilized, for instance relatively flat, so that such a container can be stored relatively simply in a refrigerator or the like. Further, a variety of additional agents, such as, for instance, cooling agents, may be provided, depending on the application. In the exemplary embodiments shown, the propellant, in normal use, is introduced above the liquid level in the first compartment, which largely prevents a gas stream through the fluid to be dispensed. In particular, premature foaming is thereby prevented. It will be clear, however, that, if desired, a different positioning of the pressure control device can be chosen, such that the propellant is led directly into the fluid to be dispensed. Thus, for instance, an exact appropriate foaming can be obtained, for instance in so-called widgets, soft drinks such as milkshakes and the like. Further, the filtering means may additionally, or exclusively, be arranged between the pressure control means 17, 117, 217, 317 and the fluid 3 to be dispensed.

These and many similar variations are understood to fall within the scope of the invention.

What is claimed is:

1. A device (1, 101, 201, 301) for dispensing a fluid, comprising a container having a first compartment (4, 104, 204, 304), an a second compartment (16, 116, 216, 316), the first compartment (4, 104, 204, 304) being arranged for receiving the fluid (3) to be dispensed, and the second compartment (16, 116, 216, 316) being arranged for receiving a propellant, while, at least during use, an opening (19) is provided between the first (4, 104, 204, 304) and the second compartment (16, 116, 216, 316), pressure control means (8; 17, 117, 217, 317) being arranged for controlling during use the pressure of propellant flowing from the second compartment (16, 116, 216, 316) into the first compartment (4, 104, 204, 304), while in the second compartment (16, 116, 216, 316) fillers (20) are provided for absorbing and/or adsorbing at least part of the propellant, wherein the propellant contains at least carbon dioxide ($CO_2$), while the fillers (20) comprise at least activated carbon, characterized in that the fluid (3) to be dispensed is a carbonated beverage, in particular beer, the pressure control means (B; 17, 117, 217, 317) being set for providing and maintaining in the first compartment (4, 104, 204, 304) an excess pressure between 0.1 and 2 bar, more particularly between 0.2 and 1 bar, and preferably about 0.7 bar relative to the surroundings.

2. A device according to claim 1, whereby the pressure control means (8; 17, 117, 217, 317) are arranged for maintaining an excess pressure during use, in the head space of the first compartment (4, 104, 204, 304) so as to obtain and maintain an equilibrium in $CO_2$ content in the fluid (3) to be dispensed.

3. A device according to claim 2, wherein the fluid (3) to be dispensed is beer, in particular of the lager type, whereby the pressure control means (8; 17, 117, 217, 317) are arranged for maintaining an excess pressure during use, in the head space of the first compartment (4, 104, 204, 304) of between 0.65 bar and 1.0 bar so as to obtain and maintain an equilibrium in a $CO_2$ content of about 4.6 gr $CO_2$ per liter beer at a bear temperature between 5° C. and 10° C.

4. A device according to anyone of claim 1–3, wherein the propellant is relatively pure $CO_2$ gas and the fillers (20) are formed at least substantially by activated carbon fibers.

5. A device according to any one on the preceding claims, wherein per liter of carbonated beverage (3), between 2 and 20 grams, in particular between 6 and 18 grams, of activated carbon (20) are provided, wherein per liter of carbonated beverage (3), between 1 and 10 grams, in particular between 2 and 8 grams, of $CO_2$ are included, associated to the fillers (20).

6. A device according to any one of the preceding claims, wherein the ratio between the volume of the first compartment (4, 104, 204, 304) and the second compartment (16, 116, 216, 316) is greater than 5.5/1, more particularly greater than 15/1, preferably greater than 50/1.

7. A device according to any one of the preceding claims, wherein the first (4, 104, 204, 304) and/or the second compartment (16, 116, 216, 316) are provided with excess pressure relief means for letting off in a controlled manner, at a pressure higher than a pre-selected maximum pressure, at least a part of the pressure fluid, while preferably a maximum pressure of less than 16 bar, in particular less than 12 bar, in the second compartment (16, 116, 216, 316) is set.

8. A device according to any one of claim 1–7, wherein the second compartment (16, 116, 216, 316) is designed as a container, preferably cartridge-like, comprising at least a part of the pressure control means (8; 17, 117, 217, 317), while means are provided for coupling the second compartment (16, 116, 216, 316) with the first compartment (4, 104, 204, 304), prior to use.

9. A device according to any one of the preceding claims, wherein a dip tube (10) is secured to the second compartment (16, 116, 216, 316), which dip tube (16) has a first end terminating adjacent the bottom of the first compartment (4, 104, 204, 304), and via its second, opposite end can be brought into fluid communication with dispensing means (7; 107, 307; 234, 235) for the fluid to be dispensed.

10. An assembly of a second compartment, a dip tube and dispensing means for use in a device according to claim 9.

11. A method for keeping fluid under pressure and dispensing said fluid, wherein the fluid is included in a container (2, 102, 202, 302), wherein a propellant is stored under relatively high pressure in a compartment (16, 116, 216, 316), wherein the compartment (16, 116, 216, 316) is brought into communication with the container (2, 102, 202, 302), such that with the aid of the propellant the fluid is pressurized and so maintained and can be dispensed via dispensing means (7; 107, 307; 234, 235), wherein prior to the introduction of the propellant into the compartment a filler (20) is introduced into the compartment which filler (20) can absorb and/or adsorb at least part of the propellant, such that an amount of propellant is introduced into the compartment (16, 116, 216, 316) at a pressure which is considerably lower than the pressure that would arise in the same compartment with the same amount of propellant and under the same external conditions if the filler (20) had not been included therein, characterized in that the propellant is introduced into the compartment (16, 116, 216, 316) under a pressure of between 4 and 14 bar, more particularly between 5 and 12 bar, and preferably about 10 bar, measured at application temperature, while using pressure control means (8; 17, 117, 217, 317) the propellant, as the fluid is dispensed via the dispensing means, is dispensed at a pressure such that in the container (2, 102, 202, 302) an excess pressure is maintained between 0.1 and 1.5 bar, more particularly 0.2 and 1 bar, and preferably about 0.7 bar relative to the surroundings.

12. A pressure cartridge for use in a device according to any one of claims 1–8 or a method according to claim 11, comprising a filler (20), in particular activated carbon fibers, capable of adsorbing and/or absorbing a propellant, in particular pure carbon dioxide, and comprising connecting means for bringing the pressure cartridge into fluid communication with a compartment in a container, for passing at least a part of the propellant into a fluid present in the container, characterized in that pressure control means are provided for maintaining, during use, a relatively constant excess pressure in a container connected to the pressure cartridge of between 0.65 and 1 bar.

13. Use of a pressure cartridge according to claim 12 in dispensing a carbonated beverage, in particular beer.

14. A pressure cartridge according to claim 12, comprising pressure control means for maintaining, during use, a relatively constant excess pressure in a container connected to the pressure cartridge of between 1.65 and 2 bars.

15. A pressure cartridge according to claim 12, wherein said filler is activated carbon and said propellant is carbon dioxide.

16. An assembly according to claim 10, wherein said dip tube is secured to the second compartment, which dip tube has a first end terminating adjacent the bottom of the first compartment, and via its second, opposite end can be brought into fluid communication with dispensing means for the fluid to be dispensed.

17. A pressure cartridge according to claim 13, wherein said carbonated beverage is beer.

18. A device according to claim 1, wherein said carbonated beverage is beer.

19. A device according to claim 1, wherein said pressure control means are set for providing and maintaining in the first compartment an excess pressure between 0.1 and 2 bar.

20. A device according to claim 19, wherein said excess pressure is between 0.2 and 1 bar.

21. A device according to claim 1, wherein said pressure control means is adapted to maintain said relatively pure $CO_2$ in the headspace of said first compartment in dynamic equilibrium with a quantity of $CO_2$ dissolved in said carbonated beverage, which dissolved $CO_2$ provides the carbonation to said carbonated beverage, wherein said pressure control means deliver a sufficient quantity of relatively pure $CO_2$ from said second compartment into the headspace of said first compartment following dispensation of a quantity of said beverage to return the pressure in the headspace of said first compartment to a desired equilibrium excess pressure.

22. A device according to claim 21, wherein said desired equilibrium excess pressure is between 0.2–1 bar.

23. A device according to claim 22, wherein said carbonated beverage is beer and said desired equilibrium excess pressure is about 0.7 bar.

24. A method according to claim 11, wherein said propellant is introduced into said compartment at a pressure of between 5 and 12 bar.

25. A method according to claim 11, wherein said excess pressure in said container is maintained between 0.2 and 1 bar.

26. A method according to claim 25, wherein said excess pressure is maintained at about 0.7 bar.

* * * * *

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 1,
Line 1, please delete "fluid" and insert therefor -- fluid. --.
Line 2, please delete "according to the preamble of claim 1.".

Column 2,
Please delete lines 20-21 and insert therefor the following paragraph:

-- In an advantageous embodiment, a device according to the invention is characterized in that the propellant is relatively pure $CO_2$ and the fillers are formed at least substantially by activated carbon fibers. --

Line 63, please delete "In," and insert therefor -- In --.

Column 3,
Please delete lines 25-26 and insert therefor the following paragraph:

-- In an alternative embodiment, a device according to the invention is characterized in that the second compartment is designed as a container, preferably cartridge-like, comprising at least a part of the pressure control means. In this embodiment, preferably means are provided for coupling the second compartment with the first compartment prior to use. --

Please delete lines 46-48 and insert therefor the following paragraph:

-- In a further, particularly advantageous embodiment, a device according to the invention is further characterized in that a dip tube is secured to the second compartment, which dip tube has a first end terminating adjacent the bottom of the first compartment, and via its second, opposite end can be brought into fluid communication with dispensing means for the fluid to be dispensed. --

Please delete lines 61-63 and insert therefor the following paragraph:

-- The invention further relates to a method for keeping under pressure and dispensing a fluid. The method is characterized in that the fluid is included in a container, and a propellant is stored under relatively high pressure in a compartment. The compartment is brought into communication with the container, such that with the aid of the propellant the fluid is pressurized and so maintained and can be dispensed via dispensing means. Prior to the introduction of the propellant into the compartment a filler is introduced into the compartment which can absorb and/or adsorb at least part of the propellant, such that an amount of propellant is introduced into the compartment at a pressure which is considerably lower than the pressure that would arise in the same compartment with the same amount of propellant and under the same It is certified that error appears in the above-identified patent and that said Letters Patent is hereby corrected as shown below:

external conditions if the filler had not been included therein. The propellant is introduced into the compartment under a pressure of between 4 and 14 bar, more particularly between 5 and 12 bar, and preferably about 10 bar, measured at application temperature. While using pressure control means, the propellant, as the fluid is dispensed via the dispensing means, is dispensed at a pressure such that in the container an excess pressure is maintained between 0.1 and 1.5 bar, more particularly 0.2 and 1 bar, and preferably about 0.7 bar relative to the surroundings. --

Column 4,
Please delete lines 7-9 and insert therefor the following paragraph:

-- The invention further relates to a pressure cartridge for use in a device, assembly or method according to the invention. Such a pressure cartridge has a filler, in particular activated carbon fibers, capable of adsorbing and/or absorbing a propellant, in particular pure carbon dioxide. The pressure cartridge also has connecting means for bringing the pressure cartridge into fluid communication with a compartment in a container, for passing at least part of the propellant into a fluid present in the container. Pressure control means are also provided for maintaining, during use, a relatively constant excess pressure in a container connected to the pressure cartridge of between 1.65 and 2 bar (absolute). --

Please delete lines 25-26 and insert therefor the following paragraph:

-- In further elaboration, a pressure cartridge according to the invention is characterized in that it is used in an apparatus for dispensing beer. --

Please delete lines 39-41 and insert therefor the following paragraph:

-- Further advantageous embodiments of a device or method according to the invention are given in the claims. --

Column 6,
Line 4, please delete "l" and insert therefor -- liters of --.
Line 12, please delete both occurrences of "content" and insert therefor -- volume --.
Line 14, please delete ">140:1, for instance 66:1." and insert therefor -- > 66:1, for instance 140:1. --
Line 20, please delete "l" and insert therefor -- liters --.
Line 21, please delete "l" and insert therefor -- liters of --.

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 6,
Line 42, please delete "content" and insert therefor -- volume --.
Line 47, please delete both occurrences of "l" and insert therefor -- liters --.
Line 64, please delete "l" and insert therefor -- liters --.
Line 66, please delete "l" and insert therefor -- liter --.
Line 67, please delete "l" and insert therefor -- liters --.

Column 10,
Line 62, please delete "contains at least" and insert therefor -- is relatively pure --.
Line 65, please delete "in particular beer,".
Line 66, please delete "(B;" and insert therefor -- (8; --.

Column 11,
Lines 1-2, please delete "between 0.1 and 2 bar, more particularly between 0.2 and 1 bar, and preferably about 0.7 bar".
Line 18, please delete "anyone of claim 1-3" and insert therefor -- claim 1 --.
Line 21, please delete "any one of the preceding claims" and insert therefor -- claim 1 --.
Line 28, please delete "any one of the preceding claims" and insert therefor -- claim 1 --.
Line 33, please delete "any one of the preceding claims" and insert therefor -- claim 1 --.
Line 41, please delete "any one of claim 1-7" and insert therefor -- claim 1 --.
Line 48, please delete "any one of the preceding claims" and insert therefor -- claim 1 --.
Line 56, please delete "according to claim 9." and insert therefor the following:

> -- for dispensing a fluid, said device comprising a container having a first compartment and said second compartment, the first compartment being arranged for receiving the fluid to be dispensed, and the second compartment being arranged for receiving a propellant, while, at least during use, on opening is provided between the first and the second compartment, pressure control means being arranged for controlling during use the pressure of propellant flowing from the second compartment into the first compartment, while in the second compartment fillers are provided for absorbing and/or adsorbing at least a part of the propellant. --

Line 57, please delete "fluid" and insert therefor -- carbonated beverage --.
Line 58, please delete both occurrences of "fluid" and insert therefor -- beverage --.
Line 59, after "propellant" please insert -- of relatively pure $CO_2$ --.

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 12,
Lines 9-10, please delete ", more particularly between 5 and 12 bar, and preferably about 10 bar,".
Lines 15-16, please delete ", more particularly 0.2 and 1 bar, and preferably about 0.7 bar"
Please delete lines 18-29 and insert therefor the following:

-- A pressure cartridge for use in a device for dispensing a fluid, said device comprising a container having a first compartment and a second compartment, the first compartment being arranged for receiving the fluid to be dispensed, and the second compartment being arranged for receiving a propellant, while, at least during use, an opening is provided between the first and the second compartment, pressure control means being arranged for controlling during use the pressure of propellant flowing from the second compartment into the first compartment, while in the second compartment fillers are provided for absorbing and/or adsorbing at least a part of the propellant, said pressure cartridge comprising a filler (20) capable of adsorbing and/or absorbing a propellant, and connecting means for bringing the pressure cartridge into fluid communication with a compartment in a container, for passing at least a part of the propellant into a fluid present in the container. --.

Please delete lines 30-31 and insert therefor the following:
-- 13. A pressure cartridge according to claim 12, wherein said fluid to be dispensed is a carbonated beverage. --.

Signed and Sealed this

Twentieth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 1,
Line 1, please delete "fluid" and insert therefor -- fluid. --.
Line 2, please delete "according to the preamble of claim 1.".

Column 2,
Please delete lines 20-21 and insert therefor the following paragraph:

-- In an advantageous embodiment, a device according to the invention is characterized in that the propellant is relatively pure $CO_2$ and the fillers are formed at least substantially by activated carbon fibers. --

Line 63, please delete "In," and insert therefor -- In --.

Column 3,
Please delete lines 25-26 and insert therefor the following paragraph:

-- In an alternative embodiment, a device according to the invention is characterized in that the second compartment is designed as a container, preferably cartridge-like, comprising at least a part of the pressure control means. In this embodiment, preferably means are provided for coupling the second compartment with the first compartment prior to use. --

Please delete lines 46-48 and insert therefor the following paragraph:

-- In a further, particularly advantageous embodiment, a device according to the invention is further characterized in that a dip tube is secured to the second compartment, which dip tube has a first end terminating adjacent the bottom of the first compartment, and via its second, opposite end can be brought into fluid communication with dispensing means for the fluid to be dispensed. --

Please delete lines 61-63 and insert therefor the following paragraph:

-- The invention further relates to a method for keeping under pressure and dispensing a fluid. The method is characterized in that the fluid is included in a container, and a propellant is stored under relatively high pressure in a compartment. The compartment is brought into communication with the container, such that with the aid of the propellant the fluid is pressurized and so maintained and can be dispensed via dispensing means. Prior to the introduction of the propellant into the compartment a filler is introduced into the compartment which can absorb and/or adsorb at least part of the propellant, such that an amount of propellant is introduced into the compartment at a pressure which is considerably lower than the pressure that would arise in the same compartment with the same amount of propellant and under the same It is certified that error appears in the above-identified patent and that said Letters Patent is hereby corrected as shown below:

external conditions if the filler had not been included therein. The propellant is introduced into the compartment under a pressure of between 4 and 14 bar, more particularly between 5 and 12 bar, and preferably about 10 bar, measured at application temperature. While using pressure control means, the propellant, as the fluid is dispensed via the dispensing means, is dispensed at a pressure such that in the container an excess pressure is maintained between 0.1 and 1.5 bar, more particularly 0.2 and 1 bar, and preferably about 0.7 bar relative to the surroundings. --

Column 4,
Please delete lines 7-9 and insert therefor the following paragraph:

-- The invention further relates to a pressure cartridge for use in a device, assembly or method according to the invention. Such a pressure cartridge has a filler, in particular activated carbon fibers, capable of adsorbing and/or absorbing a propellant, in particular pure carbon dioxide. The pressure cartridge also has connecting means for bringing the pressure cartridge into fluid communication with a compartment in a container, for passing at least part of the propellant into a fluid present in the container. Pressure control means are also provided for maintaining, during use, a relatively constant excess pressure in a container connected to the pressure cartridge of between 1.65 and 2 bar (absolute). --

Please delete lines 25-26 and insert therefor the following paragraph:

-- In further elaboration, a pressure cartridge according to the invention is characterized in that it is used in an apparatus for dispensing beer. --

Please delete lines 39-41 and insert therefor the following paragraph:

-- Further advantageous embodiments of a device or method according to the invention are given in the claims. --

Column 6,
Line 4, please delete "l" and insert therefor -- liters of --.
Line 12, please delete both occurrences of "content" and insert therefor -- volume --.
Line 14, please delete ">140:1, for instance 66:1." and insert therefor -- > 66:1, for instance 140:1. --
Line 20, please delete "l" and insert therefor -- liters --.
Line 21, please delete "l" and insert therefor -- liters of --.

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 6,
Line 42, please delete "content" and insert therefor -- volume --.
Line 47, please delete both occurrences of "l" and insert therefor -- liters --.
Line 64, please delete "l" and insert therefor -- liters --.
Line 66, please delete "l" and insert therefor -- liter --.
Line 67, please delete "l" and insert therefor -- liters --.

Column 10,
Line 62, please delete "contains at least" and insert therefor -- is relatively pure --.
Line 65, please delete "in particular beer,".
Line 66, please delete "(B;" and insert therefor -- (8; --.

Column 11,
Lines 1-2, please delete "between 0.1 and 2 bar, more particularly between 0.2 and 1 bar, and preferably about 0.7 bar".
Line 18, please delete "anyone of claim 1-3" and insert therefor -- claim 1 --.
Line 21, please delete "any one of the preceding claims" and insert therefor -- claim 1 --.
Line 28, please delete "any one of the preceding claims" and insert therefor -- claim 1 --.
Line 33, please delete "any one of the preceding claims" and insert therefor -- claim 1 --.
Line 41, please delete "any one of claim 1-7" and insert therefor -- claim 1 --.
Line 48, please delete "any one of the preceding claims" and insert therefor -- claim 1 --.
Line 56, please delete "according to claim 9." and insert therefor the following:

> -- for dispensing a fluid, said device comprising a container having a first compartment and said second compartment, the first compartment being arranged for receiving the fluid to be dispensed, and the second compartment being arranged for receiving a propellant, while, at least during use, on opening is provided between the first and the second compartment, pressure control means being arranged for controlling during use the pressure of propellant flowing from the second compartment into the first compartment, while in the second compartment fillers are provided for absorbing and/or adsorbing at least a part of the propellant. --

Line 57, please delete "fluid" and insert therefor -- carbonated beverage --.
Line 58, please delete both occurrences of "fluid" and insert therefor -- beverage --.
Line 59, after "propellant" please insert -- of relatively pure $CO_2$ --.

UNITED STATES PATENT AND TRADEMARK OFFICE

CERTIFICATE OF CORRECTION

PATENT NO. : 6,360,923 B1
DATED : March 26, 2002
INVENTOR(S) : Vlooswijk

It is certified that error appears in the above-identified patent and that said Letters Patent is hereby corrected as shown below:

Column 12,
Lines 9-10, please delete ", more particularly between 5 and 12 bar, and preferably about 10 bar,".
Lines 15-16, please delete ", more particularly 0.2 and 1 bar, and preferably about 0.7 bar"
Please delete lines 18-29 and insert therefor the following:

-- A pressure cartridge for use in a device for dispensing a fluid, said device comprising a container having a first compartment and a second compartment, the first compartment being arranged for receiving the fluid to be dispensed, and the second compartment being arranged for receiving a propellant, while, at least during use, an opening is provided between the first and the second compartment, pressure control means being arranged for controlling during use the pressure of propellant flowing from the second compartment into the first compartment, while in the second compartment fillers are provided for absorbing and/or adsorbing at least a part of the propellant, said pressure cartridge comprising a filler (20) capable of adsorbing and/or absorbing a propellant, and connecting means for bringing the pressure cartridge into fluid communication with a compartment in a container, for passing at least a part of the propellant into a fluid present in the container. --.

Please delete lines 30-31 and insert therefor the following:
-- 13. A pressure cartridge according to claim 12, wherein said fluid to be dispensed is a carbonated beverage. --.

Signed and Sealed this

Twenty-seventh Day of August, 2002

*Attest:*

*Attesting Officer*

JAMES E. ROGAN
*Director of the United States Patent and Trademark Office*